US006758707B2

(12) United States Patent
Creighton

(10) Patent No.: US 6,758,707 B2
(45) Date of Patent: Jul. 6, 2004

(54) PROPELLER DRIVE SHAFT MOUNTING SUPPORT UNIT FOR AN INBOARD DRIVE MARINE VESSEL AND METHOD OF FORMING SAME

(75) Inventor: Timothy Patrick Creighton, Ada, MI (US)

(73) Assignee: Acme Marine Group, L.L.C., Big Rapids, MI (US)

( * ) Notice: Subject to any disclaimer, the term of this patent is extended or adjusted under 35 U.S.C. 154(b) by 0 days.

(21) Appl. No.: 10/292,184

(22) Filed: Nov. 12, 2002

(65) Prior Publication Data

US 2004/0092178 A1 May 13, 2004

(51) Int. Cl.[7] ..... B63H 23/36

(52) U.S. Cl. ..... 440/83; 440/53; 440/112; 277/391

(58) Field of Search ..... 440/83, 112, 53, 440/61 R, 82, 57, 63; 277/391; 384/97, 125

(56) References Cited

U.S. PATENT DOCUMENTS 2,306,664 A * 12/1942 Scott-Paine ..... 440/112
2,840,425 A * 6/1958 Howell ..... 384/97
3,362,765 A * 1/1968 Pierce ..... 384/125
3,407,779 A * 10/1968 Satterthwaite et al. ..... 440/83
4,334,872 A * 6/1982 Gaston ..... 440/61 R
4,344,630 A * 8/1982 Veres ..... 440/112
4,710,142 A * 12/1987 Lovell ..... 440/83
4,832,638 A * 5/1989 Sirois ..... 440/83
5,100,350 A * 3/1992 Buzzi ..... 440/82
5,310,372 A 5/1994 Tibbetts
5,911,607 A * 6/1999 Lacko et al. ..... 440/83
6,302,750 B1 10/2001 Foreman
6,361,388 B2 3/2002 Foreman
6,482,057 B1 * 11/2002 Schoell ..... 440/53

* cited by examiner

*Primary Examiner*—S. Joseph Morano
*Assistant Examiner*—Lars Olson
(74) *Attorney, Agent, or Firm*—Miller, Johnson, Snell & Cummiskey, P.L.C.

(57) ABSTRACT

A mounting support (100, 200) for a marine vessel inboard drive propulsion system used in connection with a precision driveline includes a substantially cylindrical housing (107), one or more bearing assemblies (113) positioned within the cylindrical housing (107) for promoting rotation of a drive shaft (103) and one or more seals (119) typically located at both ends of the housing (107) for preventing water from contacting one or more of the bearing assemblies (113).

47 Claims, 6 Drawing Sheets

PROPELLER DRIVE SHAFT MOUNTING SUPPORT UNIT FOR AN INBOARD DRIVE MARINE VESSEL AND METHOD OF FORMING SAME

TECHNICAL FIELD

This invention relates in general to marine vessels and more particularly to a marine inboard propulsion system.

BACKGROUND

Marine vessels such as small water skiing boats and the like typically utilize inboard propeller drive propulsion systems. Unlike an outboard type of propulsion drive, the inboard drive system includes a motor within the boat that includes a drive shaft extending through the hull to the stern. The drive shaft drives a propeller. The advantage of inboard drive as opposed to other types of marine propulsion systems is that the rotation of the propeller causes fewer vortex turbulents generated by the propeller at the surface of the water. This permits a rapid start of the boat while allowing a water skier to traverse across a fewer rear wake vortices generated by the propeller without the water turbulents generally associated with other types of marine drives, such as outboard and stern drive systems.

As seen in prior art FIG. 1, one typical implementation of a inboard drive system 10 includes a motor 11 that uses a drive coupling 13 to rotate a drive shaft 15 through a stuffing box 17. As best seen in prior art FIG. 2, the stuffing box 17 is a cylindrical structure that allows the drive shaft 15 to pass though the hull 19 of the boat. The stuffing box 17 generally is a flexible hose or rubber housing 21 sealed by hose clamps 23 or the like. The stuffmg box 17 is typically filled or "stuffed" with stuffing rope to prevent water leakage into the boat around the drive shaft 15. Although the stuffing box 17 may be integrally fastened to the hull 19, a user must continually insure that the packing nut 26 and hose clamps 23 are secured tightly so as to prevent water from entering inside the boat hull. Moreover, the stuffing box 17 must be precisely aligned with that portion of the boat's hull allowing the shaft to pass though. Since the shaft log 22 is fixed into position, any misalignment provides additional friction and wear to the shaft as it passes though the rubber housing 21 and packing nut 26.

In FIG. 3, as the drive shaft 15 extends from the transmission coupling, through the stuffing box 17, to be supported by a strut 25. In some instances the drive shaft 15 may be enclosed within protective oil lubricated cover or tube 27 to prevent water, mud and/or other liquids from entering the enclosure. Alternatively, the drive shaft 15 will extend directly through the strut 25 which provides support for the drive shaft 15 before reaching a propeller (not shown). The strut 25 typically includes a mounting blade 31 which acts to fix the strut 25 at some predetermined position on the hull of the boat. The strut further includes some type of water lubricated bearing (not shown) such as a cutless bushing to allow the drive shaft 15 to spin within the strut 25 using water as a lubricant. Problems typically associated with this type of arrangement include the friction and continual wear of the water lubricated bearing. Over time excessive play can develop within the strut to the extent that the drive shaft will move laterally and/or radially and is no longer held into a fixed position during rotation. Hence, the strut requires continual attention, repair and replacement of the water lubricated bearing to insure the most optimum and efficient transfer of power to the propeller 29 to help reduce the undesired effects of vibration and movement.

In view of these shortcomings in the prior art drive system, the need exists to construct a more efficient means for providing support of drive shaft during its rotation in an inboard drive marine vessel propulsion system. This will insure very little maintenance and an efficient means to transfer power to a marine propeller while aiding in the support of the driveline.

SUMMARY OF THE INVENTION

Briefly, according to the invention, there is provided a mounting support for use in an inboard drive marine propulsion system. A center support and rear strut include one or more bearing assemblies and well as a seal at both ends of a support housing for reventing water from entering the support housing. Roller bearings are used to enhance rotational movement of a drive shaft while providing very little or no lateral movement. This greatly reduces wear and maintenance of the mounting support items to provide more efficient and less expensive operation of the marine vessel.

BRIEF DESCRIPTION OF THE DRAWINGS

The features of the present invention, which are believed to be novel, are set forth with particularly in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENTS

Figure 1:
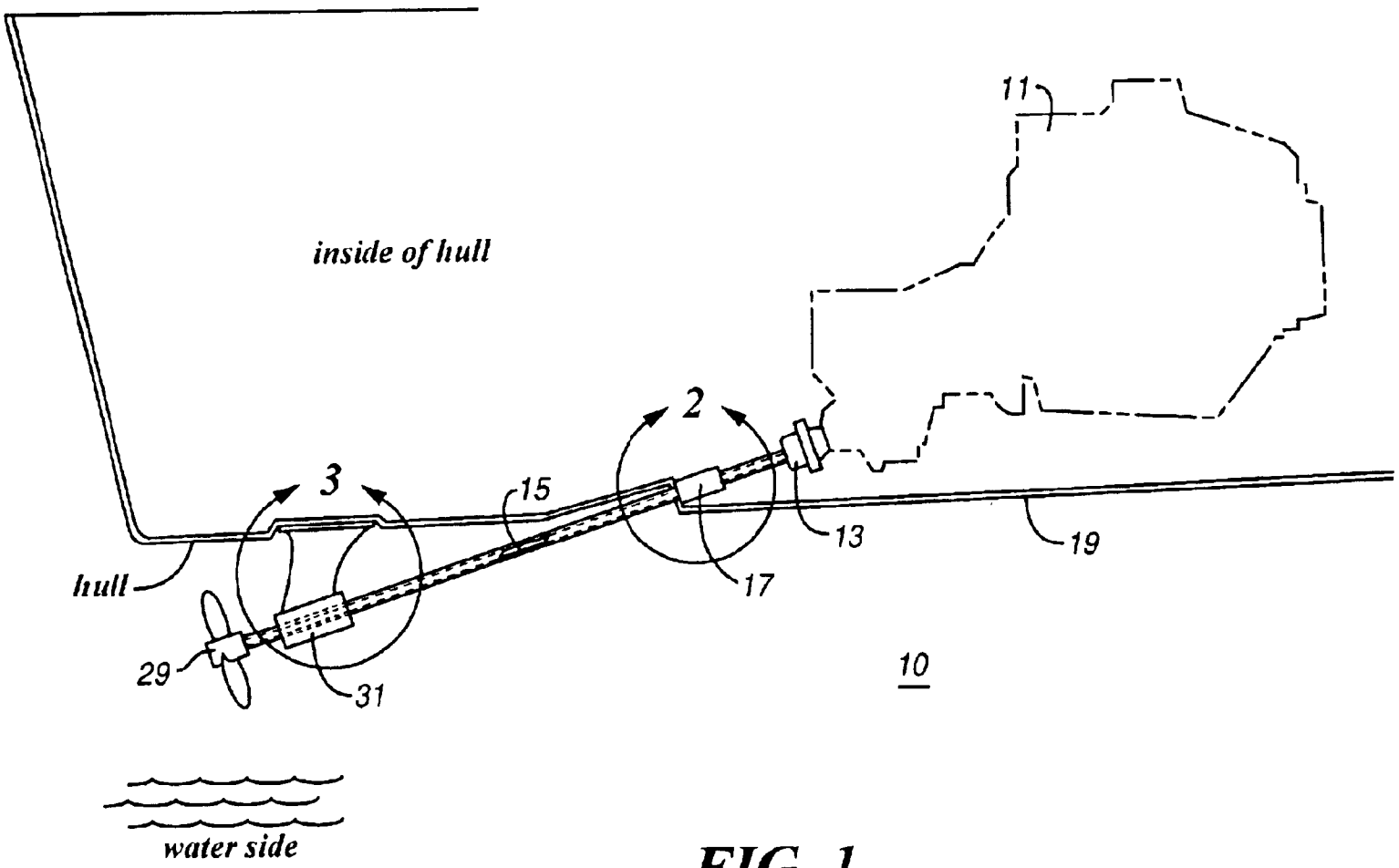
FIG. 1 (PRIOR ART)
FIG. 1 is a side view of the prior art inboard drive system for a marine vessel.
Figure 2:
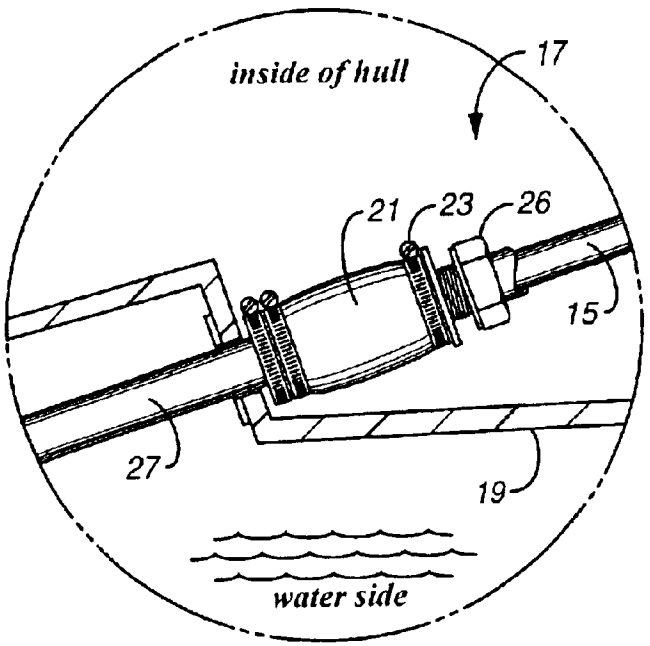
FIG. 2 (PRIOR ART)
FIG. 2 is a side view of a prior art stuffing box used in an inboard drive propulsion system.
Figure 3:
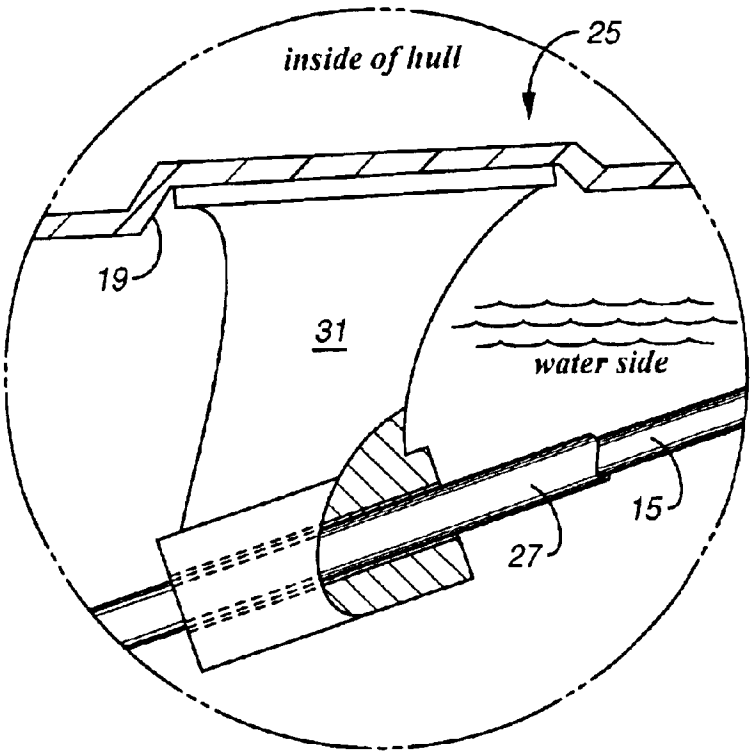
FIG. 3 (PRIOR ART)
FIG. 3 is a side view of a prior art strut used in an inboard drive propulsion system.

While the specification concludes with claims defining the features of the invention that are regarded as novel, it is believed that the invention will be better understood from a consideration of the following description in conjunction with the drawing figures, in which like reference numerals are carried forward.

Referring now to FIGS. 4 to 7, both a center support (FIG. 4) and a rear strut (FIG. 5) are shown and will be generally referred to as a center mounting support 100. It should be recognized by those skilled in the art that embodiments other than a center support or strut are also possible. Although terms such as "center" as used throughout, it will be recognized that this refers to a support in the general sense and not at the precise center of the marine vessel.

Figure 4:
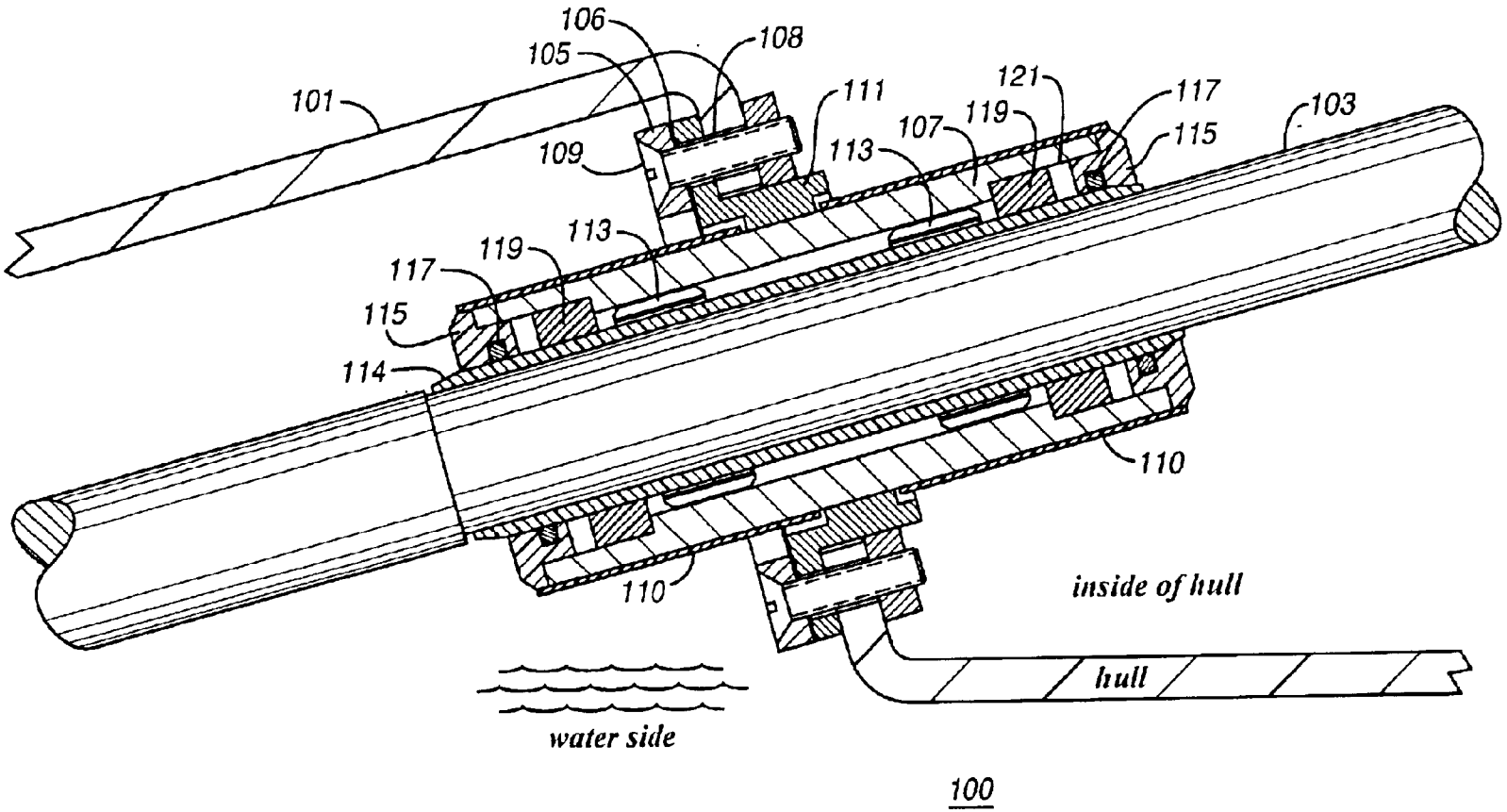
FIG. 4 is a side cross-sectional view of the center support in accordance with the preferred embodiment of the invention.
Figure 6:
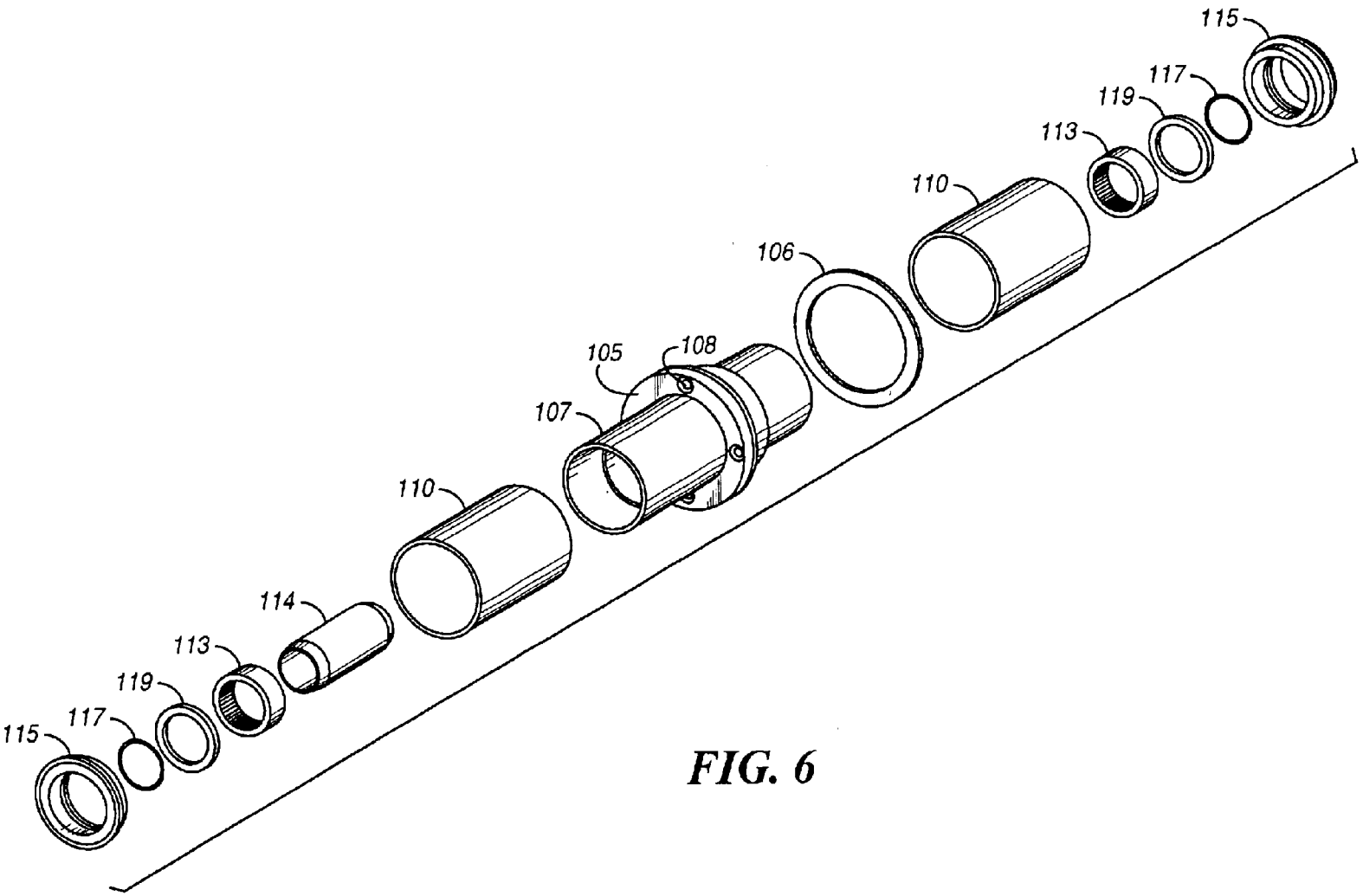
FIG. 6 is an exploded view of the center support.

As seen in FIGS. 4 and 6, a dripless center support 100 is mounted to the hull 101 of a inboard drive marine vessel so as to allow a drive shaft assembly 103 to gain support thereby holding it into a fixed position during its rotation. Additionally, the center mounting support 100 facilitates rotational movement while reducing whip of the drive shaft assembly 103 as well as preventing water or other liquid or semi-liquid materials such as mud from entering though the exterior of the hull 101. In order to mount the center support 100 to prevent the entry of water while still providing a tight seal, the support 100 includes a flexible mounting ring 105. The mounting ring 105 may be a substantially circular ring molded to a rubber membrane 111 that is fitted to the exterior of the housing such as cylindrical shaft body 107 of the mounting support 100. The cylindrical shaft body 107 includes a rubber casing 110 to provide protection while immersed in water. The mounting ring 105 includes a plurality of mounting holes 108 to allow a screw 109 of other fastening means (not shown) to nest or secure the mounting ring 105 into a hole made within the hull 101. A mounting seal 106 is used to provide a watertight fit between the mounting ring 105 and rubber membrane 111. The mounting ring 105 is preferably comprised of a metallic material such as brass, steel, nibral, aluminum or the like to allow for a firm and secure mounting surface to the hull 101.

In order to allow the mounting ring 105 to be mounted to the hull 101 while still having a certain degree of flexibility, a rubber membrane 111 is adhered from the back of the ring. The membrane 111 is pliable allowing the cylindrical shaft body 107 of the center support 100 to move and flex to a limited degree about the mounting ring 105. This has a great advantage in that the center mounting support 100 may be mounted in any number of positions depending on the hull angle to the drive shaft assembly 103 which will extend through the hull 101. This gives the center support 100 even greater versatility since it is not rigidly mounted into position that would allow only one angle of entry for the drive shaft assembly 103. The flexible movement of the center support ring and tube also allows engine movement due to vibration, or shrink/swelling of steel, fiberglass and wood used in boat construction. The flex membrane 111 is adhered to the back of the mounting ring 105 and extends substantially along the sides of the cylindrical shaft body 107.

Figure 5:
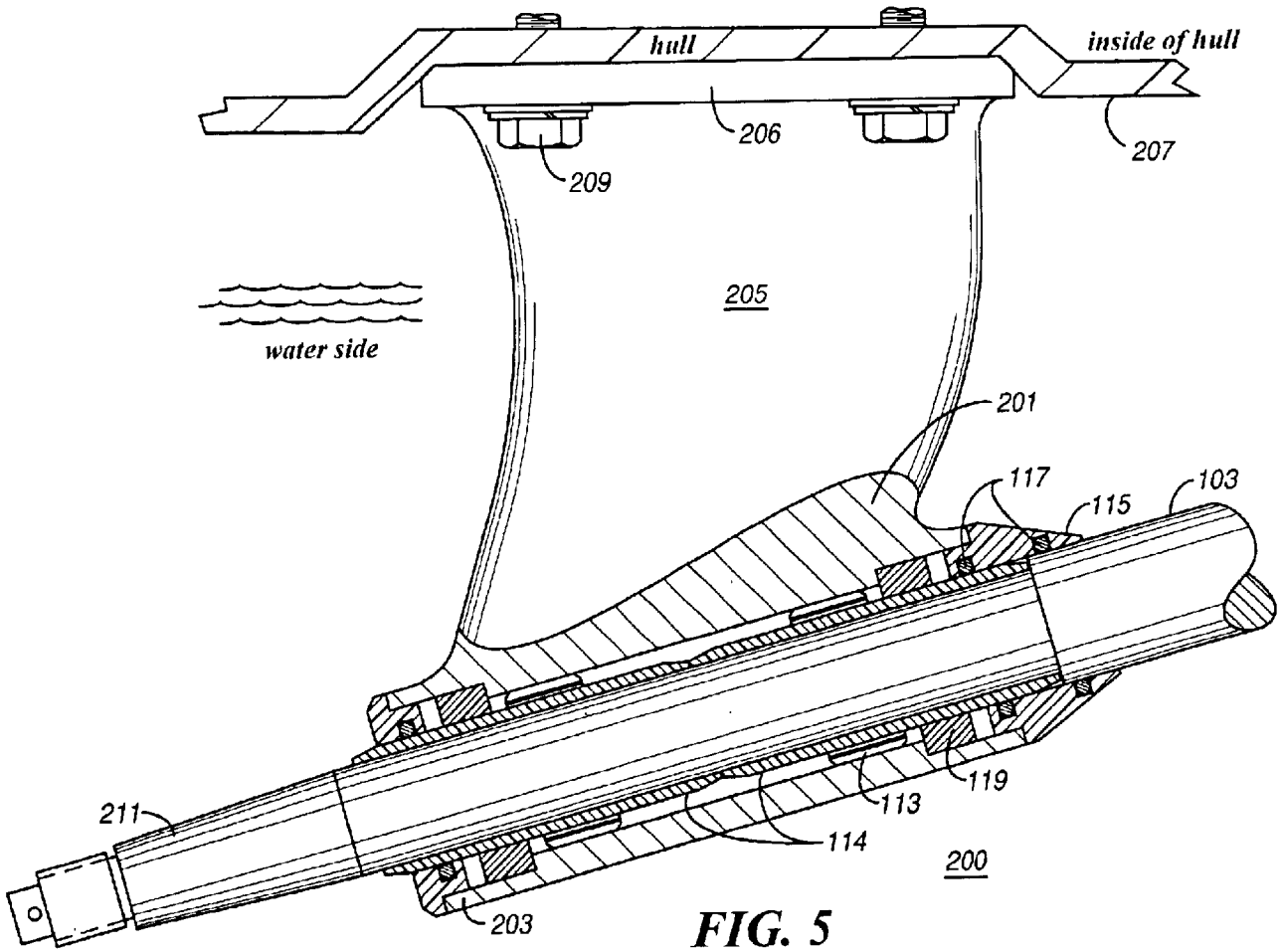
FIG. 5 is a side cross-sectional view of the strut support in accordance with the preferred embodiment of the invention.

As best seen in FIGS. 4 and 5, the cylindrical shaft body 107 is constructed of a metallic body or other ridged structure that may include a rubberized coating. The cylindrical shaft body 107 facilitates movement of the drive shaft assembly 103 though the boat hull 101. The body is substantially hollow and includes a plurality of components to support the shaft in its rotational movement while providing the least amount of friction to the drive shaft assembly 103. The drive shaft assembly 103 passes through one or more needle bearing or roller bearing assemblies 113 and a sleeve 114 that are used within the cylindrical shaft body 107 to enhance rotational movement of the drive shaft assembly 103. Since the surface of the drive shaft assembly 103 will be manufactured of a relatively soft material such as stainless steel or the like, the sleeve 114 is adhered to the surface of the drive shaft assembly 103. This enables the hardness of the surface of the drive shaft assembly to be increased to approximately a 60 Rockwell in order to allow the drive shaft assembly 103 to work more efficiently with the roller bearing assemblies 113 and seals 119. Preferably, each roller bearing assembly 113 includes a plurality of substantially spherical roller ball bearings that move within a closed track. As will be further recognized by those skilled in the art, a needle bearing assembly will also be applicable since the bearings would surrounds and rotate about the drive shaft assembly 103. The drive shaft assembly 103 is in contact with these bearings while the bearing work to both provides structural support for the drive shaft assembly 103 while facilitating rotation while within the center mounting support 100. Preferably each roller bearing assembly 113 would be sealed and would require no lubrication or other maintenance.

In order to prevent water and/or other harmful material from entering the center mounting support 100, one or more seal assemblies as used at one or both ends of the cylindrical shaft body 107 to insure that the components therein are impervious to external influence. A seal assembly may only be used at one end of the cylindrical shaft body 107 in the instance where one end of the support remains within the vessel and no water or other material would enter that end of the cylindrical shaft body 107. As will be evident to those skilled in the art, water or other materials coming in contact with the bearing assemblies 113 would damage bearing and other components within the center support 100. Each seal assembly includes a water deflector 115, gasket 117 and a seal 119. The water deflector 115 is frictionally engaged to the cylindrical drive shaft body 103 and is used to deflect water away from the outer face of the seal 119. Any water that does enter past the water deflector 115 is further trapped outside the roller bearing assemblies 113 by a seal 119. Typically the seal is made of a rubberized or other pliable material that will form a tight seal within the side body of the cylindrical shaft body 107 as well as the drive shaft 103. As best seen in FIG. 4, the cylindrical shaft body includes a counterbore 121 that is cut within the center support 100 to a predetermined depth thereby reducing the inner diameter of the cylindrical shaft body 107 at its ends. The counterbore 121 permits the seal 119 to obtain a tightly sealed fit within the counterbore 121 while the deflector 115 is used to further seal any gap between the water seal 119 and the support tube. The use of these components to from a seal assembly essentially prevents water from entering the ends of the cylindrical shaft body 107 that would work to damage the roller bearing assemblies 113 therein.

Figure 7:
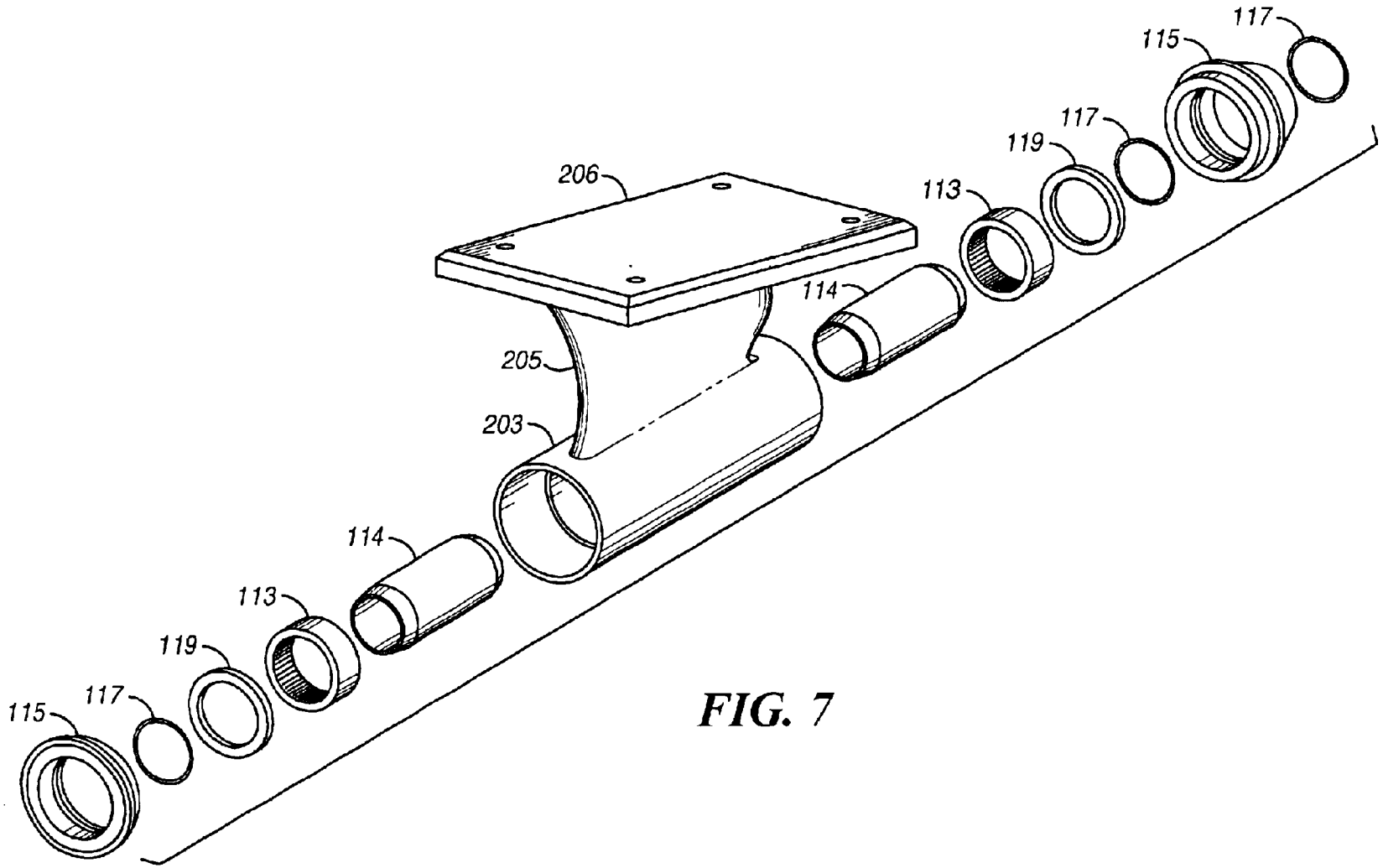
FIG. 7 is an exploded view of the strut support.

As best seen in FIGS. 5 and 7, this embodiment illustrates a strut support assembly 200 depicted in the form of a strut 201 used at the rear of the marine vessel for the supporting a drive shaft assembly 103 before being attached to a propeller mount 211 and propeller (not shown). Similar to the center support 100, the strut support assembly 200 includes a similar component structure within the strut 201 including a plurality of bearing assemblies and seal assemblies. The strut 201 includes a strut housing 203 having a blade 205 and flange 206 for fastening the strut 201 to the bottom of the vessel hull 207. The blade 205 is preferably tapered on the leading edge for efficiency and set at an angle to allow the drive shaft assembly 103 to extend under the hull 207 at some predetermined angle. The blade 205 with flange 206 is typically fastened against the hull 207 though the use of screw fasteners 209 or the like.

The present invention allows for the quiet, smooth and efficient operation of an inboard drive marine vessel using the invention as described herein in as a center support and/or a strut. The invention reduces the vessel's operating expense while providing little maintenance or repair as compared with stuffing boxers or water lubricated struts used in prior art designs. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A mounting support for a marine vessel drive propulsion system comprising:

a substantially cylindrical housing;

a plurality of bearing assemblies positioned within the cylindrical housing for promoting rotation of a drive shaft;

a plurality of seals located at least one end of the housing for preventing water from contacting the plurality of bearing assemblies; and a flexible membrane mounted within the mounting support for varying the angle of the drive shaft for correcting misalignment between the drive shaft and the hull of the marine vessel.

2. A mounting support as in claim 1, wherein the plurality of bearing assemblies are needle bearings.

3. A mounting support as in claim 1, wherein the plurality of bearing assemblies are roller bearings.

4. A mounting support as in claim 1, further comprising a sleeve positioned within the cylindrical housing for frictionally engaging the plurality of bearing assemblies therein.

5. A mounting support as in claim 1, further comprising a plurality of deflectors located at each end of the cylindrical housing for deflecting water away from the plurality of seals.

6. A mounting support as in claim 5, further comprising at least one gasket for sealing the surface between the plurality of seals and the plurality of deflectors.

7. A mounting support as in claim 6, wherein the gasket is an "O" shaped ring.

8. A mounting support as in claim 1, further comprising a support member integrally connected with the housing for mounting the cylindrical housing to a fixed surface.

9. A mounting support as in claim 1, wherein the drive shaft extends though the cylindrical housing.

10. A mounting support as in claim 1, wherein the mounting support is a center support member for supporting the drive shaft through the hull of the marine vessel.

11. A mounting support as in claim 1, wherein the marine vessel has an inboard drive.

12. A mounting support as in claim 1, wherein the mounting support is a strut for supporting the drive shaft under the hull of the marine vessel.

13. A drive shaft support system for use in an inboard drive marine vessel comprising:

a center support having a flexible membrane for supporting an engine drive shaft though the hull of the marine vessel;

a strut for supporting an engine drive shaft under the hull of the marine vessel at a point before reaching a propeller; and wherein both the center support and the strut are sealed and include at least one bearing assembly therein for promoting rotation of the drive shaft.

14. A drive shaft support system as in claim 13, further comprising a sleeve fixed to the drive shaft for facilitating movement of the drive shaft within the at least one bearing assembly.

15. A drive shaft support system as in claim 13, wherein the sealed center support member and strut are impervious to external influence such as water.

16. A drive shaft support system as in claim 13, wherein the bearing assembly includes:

at least one circumferential bearing positioned within the center support member and strut for facilitating movement of the engine drive shaft; and a plurality seal assemblies for preventing external fluids from contacting the at least one circumferential bearing.

17. A drive shaft support system as in claim 13, wherein the circumferential bearing is a needle bearing.

18. A drive shaft support system as in claim 13, wherein the circumferential bearing is a roller bearing.

19. A drive shaft support system as in claim 13, wherein the seal assembly includes:

a pliable seal; and a deflector for deflecting fluid from the seal.

20. A drive shaft mount for use in a marine vessel inboard drive comprising:

a housing;

at least one bearing positioned within the housing for facilitating the rotation of a drive shaft;

a seal assembly for preventing fluids from entering at least one end of the housing; and a flexible mounting ring for mounting the drive shaft at a predetermined angle in relation to the hull of the marine vessel.

21. A drive shaft mount as in claim 20:

wherein the mount is a center support for supporting a drive shaft though the hull of a marine vessel.

22. A drive shaft mount as in claim 20, wherein the seal assembly includes:

a seal positioned adjacent to the at least one bearing; and a deflector for deflecting fluid away from the seal.

23. A drive shaft mount as in claim 22, wherein seal assembly further includes at least one gasket for providing a tight seal between the seal and deflector.

24. A drive shaft mount as in claim 20, wherein the at least one bearing is a needle bearing.

25. A drive shaft mount as in claim 20, wherein the at least one bearing is a roller bearing.

26. A drive shaft mount as in claim 20, further comprising:

a sleeve positioned within the housing for frictionally engaging with the at least one bearing and drive shaft during rotation.

27. A drive shaft mount as in claim 20:

wherein the mount is a support strut for supporting a drive shaft under a marine vessel.

28. A mount for providing support to a drive shaft assembly in a marine vessel inboard drive comprising:

a cylindrical housing;

a plurality of roller bearing assemblies where at least one of the plurality of roller bearing assemblies is positioned substantially at either end of the housing for facilitating movement of the drive shaft assembly;

a plurality of seal assemblies where at least one of the plurality of seal assemblies is positioned outside of the at least one of the plurality of roller bearing assemblies to prevent water from contacting the plurality of roller bearing assemblies; and a flexible membrane and mounting ring for mounting the center support member at a predetermined angle in relation to the hull.

29. A mount as in claim 28, wherein the mount is a strut support for supporting the drive shaft assembly under the hull of the marine vessel at some predetermined distance from a propeller.

30. A mount as in claim 28, wherein the strut support includes a mounting blade for mounting the strut at a predetermined angle in relation to the hull.

31. A mount as in claim 28, wherein the plurality of roller bearing assemblies are substantially circular with a plurality of roller bearings moving within an enclosed track.

32. A mount as in claim 28, wherein the plurality of seal assemblies include:

at least one seal; and a deflector for deflecting water away from the seal.

33. A mount as in claim 32, wherein the plurality of seal assemblies further include a gasket for providing a seal between the drive shaft and deflector.

34. A mount as in claim 28, further comprising: a sleeve fixed to the drive shaft for positioning at least one of the plurality of bearing assemblies at a predetermined location within the housing.

35. A mount as in claim 28, further comprising a sleeve fixed to the drive shaft and plurality of roller bearing assemblies and facilitating movement thereof.

36. A mount as in claim 28, wherein the mount is a center support for supporting the drive shaft assembly though the hull of the marine vessel.

37. A method of supporting a propeller drive shaft assembly in an inboard drive marine vessel comprising the steps of:

providing a cylindrical housing;

positioning at least one roller bearing assembly within the cylindrical housing;

sealing both ends of the cylindrical housing with a seal assembly for preventing water from contacting the at least one roller bearing assembly; and mounting the center support member using a substantially flexible mounting ring at a predetermined angle in relation to the hull.

38. A method of supporting a propeller drive shaft assembly as in claim 37, wherein the cylindrical housing is a center support member for providing support for the drive shaft assembly through the hull of the marine vessel.

39. A method of supporting a propeller drive shaft assembly as in claim 37, wherein the cylindrical housing is a strut for providing support for the drive shaft assembly under the hull of the marine vessel.

40. A method of supporting a propeller drive shaft assembly as in claim 37, wherein the strut includes a mounting flange for mounting the strut at a predetermined angle in relation to the hull.

41. A method of supporting a propeller drive shaft assembly as in claim 37,wherein the seal assembly includes at least one seal washer and a diverter for diverting water from the seal washer.

42. A method of supporting a propeller drive shaft assembly as in claim 41, further comprising a gasket for sealing the area between the at least one seal washer and the diverter.

43. A method of supporting a propeller drive shaft assembly as in claim 37, wherein the cylindrical housing is not filled with lubricant.

44. A mounting support for a marine vessel drive propulsion system comprising:

a center support for supporting a drive shaft;

a flexible membrane mounted within the center support for varying the angle of the drive shaft in relation to the hull of the marine vessel;

a sleeve for frictionally engaging at least one bearing assembly therein; and wherein the drive shaft angle is varied in order to correct any misalignment between the drive shaft and the hull.

45. A mounting support for a marine vessel as in claim 44, wherein the angle is varied in order to correct any misalignment between the draft shaft and the hull.

46. A mounting support for a marine vessel as in claim 44, further comprising:

at least one bearing assembly positioned within the center support for promoting rotation of the drive shaft.

47. A mounting support for a marine vessel as in claim 46, further comprising a seal assembly for preventing water from contacting the bearing assembly.

* * * * *

UNITED STATES PATENT AND TRADEMARK OFFICE

CERTIFICATE OF CORRECTION

PATENT NO. : 6,758,707 B2
DATED : July 6, 2004
INVENTOR(S) : Timothy Patrick Creighton It is certified that error appears in the above-identified patent and that said Letters Patent is hereby corrected as shown below:

Column 1,
Line 27, “a inboard” should read -- an inboard --
Line 34, "stuffmg” should read -- stuffing --
Line 46, delete "as"

Column 2,
Line 64, "a inboard” should read -- an inboard --

Column 3,
Line 3, “though” should read -- through --
Line 13, "of” (second occurrence) should read -- or --
Line 43, "though” should read -- through --
Line 63, "surrounds” should read -- surround --
Line 65, "bearing work to both provides” should read -- bearings work to provide --

Column 4,
Line 7, "as used” should read -- are used --
Line 33, “to from” should read -- to form --
Line 52, "though” should read -- through --
Line 57, "herein in as" should read -- herein as --

Signed and Sealed this

Twenty-first Day of December, 2004

JON W. DUDAS
*Director of the United States Patent and Trademark Office*